US007013606B2

(12) United States Patent
Sigrist et al.

(10) Patent No.: US 7,013,606 B2
(45) Date of Patent: Mar. 21, 2006

(54) ROOF PIPE CHASE HOUSING SYSTEM

(76) Inventors: Peter C. Sigrist, 17229 NE. 6th Pl., Bellevue, WA (US) 98008; Robert L. Studer, 7703 Lake Alice Rd. SE., Fall City, WA (US) 98024

( * ) Notice: Subject to any disclaimer, the term of this patent is extended or adjusted under 35 U.S.C. 154(b) by 133 days.

(21) Appl. No.: 10/288,981

(22) Filed: Nov. 5, 2002

(65) Prior Publication Data

US 2004/0093813 A1 May 20, 2004

Related U.S. Application Data

(63) Continuation-in-part of application No. 10/207,755, filed on Jul. 30, 2002, now abandoned.

(51) Int. Cl.
*E04D 3/38* (2006.01)

(52) U.S. Cl. ..... 52/58; 52/60; 52/656.2; 52/200

(58) Field of Classification Search ..... 52/58, 52/60, 200, 199, 656.2, 658, 745.19; 248/237, 248/148
See application file for complete search history.

(56) References Cited

U.S. PATENT DOCUMENTS

| | | | | | |
|---|---|---|---|---|---|
| 3,807,110 | A | | 4/1974 | Kaminski | 52/219 |
| 3,945,163 | A | | 3/1976 | Nagler et al. | 52/219 |
| 4,197,682 | A | * | 4/1980 | Schiff et al. | 52/72 |
| 4,428,166 | A | | 1/1984 | Burghart | 52/19 |
| 4,480,534 | A | * | 11/1984 | Sloan | 454/182 |
| 5,213,111 | A | | 5/1993 | Cook et al. | 128/772 |
| 5,349,790 | A | | 9/1994 | Beetles et al. | 52/19 |
| 5,454,538 | A | * | 10/1995 | Merideth | 248/237 |
| 5,647,175 | A | * | 7/1997 | Smyth | 52/58 |
| 5,687,514 | A | * | 11/1997 | Gillispie | 52/58 |
| 5,706,610 | A | | 1/1998 | Mayle | 52/60 |
| 5,791,092 | A | | 8/1998 | Strieter | 52/27 |
| 6,067,759 | A | * | 5/2000 | House | 52/198 |
| 6,151,838 | A | * | 11/2000 | Husein | 52/58 |
| 6,155,008 | A | * | 12/2000 | McKee | 52/198 |
| 6,251,007 | B1 | * | 6/2001 | Smith | 454/292 |
| 6,343,439 | B1 | * | 2/2002 | Rutledge | 52/27 |

* cited by examiner

*Primary Examiner*—Daniel P. Stodola
*Assistant Examiner*—Nahid Amiri

(57) ABSTRACT

A roof pipe chase housing system for allowing pipes to pass through a roof without leaking. The roof pipe chase housing system includes a roof curb, a housing structure attached to the roof curb, and a tower structure attached to the housing structure. The housing structure has a side panel for allowing one or more access openings to be positioned within that receive a pipe in a sealed manner. The housing structure preferably includes an extended lip that prevents water from entering between the housing structure and the roof curb. The tower structure is capable of supporting one or more electrical disconnect switches and other devices.

15 Claims, 10 Drawing Sheets

ROOF PIPE CHASE HOUSING SYSTEM

CROSS REFERENCE TO RELATED APPLICATIONS

I hereby claim benefit under Title 35, United States Code, Section 120 of U.S. patent application Ser. No. 10/207,755 filed Jul. 30, 2002. This application is a continuation-in-part of the Ser. No. 10/207,755 application filed Jul. 30, 2002, now abandoned. The Ser. No. 10/207,755 application is currently pending. The Ser. No. 10/207,755 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to roof curbs and more specifically it relates to a roof pipe chase housing system for allowing pipes to pass through a roof without leaking.

2. Description of the Related Art

Roof curbs have been in use for years. Typically, roof curbs are comprised of a housing structure that is secured to a roof about an opening within the roof. The roof curbs allow for pipes, conduit and other devices to extend through thereof.

Conventional roof curbs do not provide an adequate structure for extending pipes, conduit and other structures through the roof in a manner that do not leak. A further problem with conventional roof curbs is that they do not provide an adequate structure for mounting electrical outlets and disconnects.

Examples of patented devices which may be related to the present invention include U.S. Pat. No. 5,349,790 to Beetles et al.; U.S. Pat. No. 3,945,163 to Nagler et al.; U.S. Pat. No. 4,428,166 to Burghart; U.S. Pat. No. 5,706,610 to Mayle; U.S. Pat. No. 3,807,110 to Kaminski; U.S. Pat. No. 5,791,092 to Strieter; and U.S. Pat. No. 5,213,111 to Cook et al.

While these devices may be suitable for the particular purpose to which they address, they are not as suitable for allowing pipes to pass through a roof without leaking. Conventional roof curbs do not provide the versatility required in a modern building structure.

In these respects, the roof pipe chase housing system according to the present invention substantially departs from the conventional concepts and designs of the prior art, and in so doing provides an apparatus primarily developed for the purpose of allowing pipes to pass through a roof without leaking.

BRIEF SUMMARY OF THE INVENTION

In view of the foregoing disadvantages inherent in the known types of roof curbs now present in the prior art, the present invention provides a new roof pipe chase housing system construction wherein the same can be utilized for allowing pipes to pass through a roof without leaking.

The general purpose of the present invention, which will be described subsequently in greater detail, is to provide a new roof pipe chase housing system that has many of the advantages of the roof curbs mentioned heretofore and many novel features that result in a new roof pipe chase housing system which is not anticipated, rendered obvious, suggested, or even implied by any of the prior art roof curbs, either alone or in any combination thereof.

To attain this, the present invention generally comprises a roof curb, a housing structure attached to the roof curb, and a tower structure attached to the housing structure. The housing structure has a side panel for allowing one or more access openings to be positioned within that receive a pipe in a sealed manner. The housing structure preferably includes an extended lip that prevents water from entering between the housing structure and the roof curb. The tower structure is capable of supporting one or more electrical disconnect switches and other devices.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a roof pipe chase housing system that will overcome the shortcomings of the prior art devices.

A second object is to provide a roof pipe chase housing system for allowing pipes to pass through a roof without leaking.

Another object is to provide a roof pipe chase housing system that is easy to install upon an existing or new roof.

An additional object is to provide a roof pipe chase housing system that allows for multiple pipes and conduit to extend from within without water leakage.

A further object is to provide a roof pipe chase housing system that provides a location for pipes and conduit to turn at right angles.

Another object is to provide a roof pipe chase housing system that is capable of receiving an outdoor electrical outlet.

A further object is to provide a roof pipe chase housing system that reduces the likelihood of roof leakage occurring.

Another object is to provide a roof pipe chase housing system that allows for the installation of additional pipes and conduit without penetrating the roof in a new location.

A further object is to provide a roof pipe chase housing system that is capable of supporting an electrical disconnect switch.

Another object is to provide a roof pipe chase housing system that eliminates the need for an electrician to build a tree to support an electrical disconnect switch on a roof.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
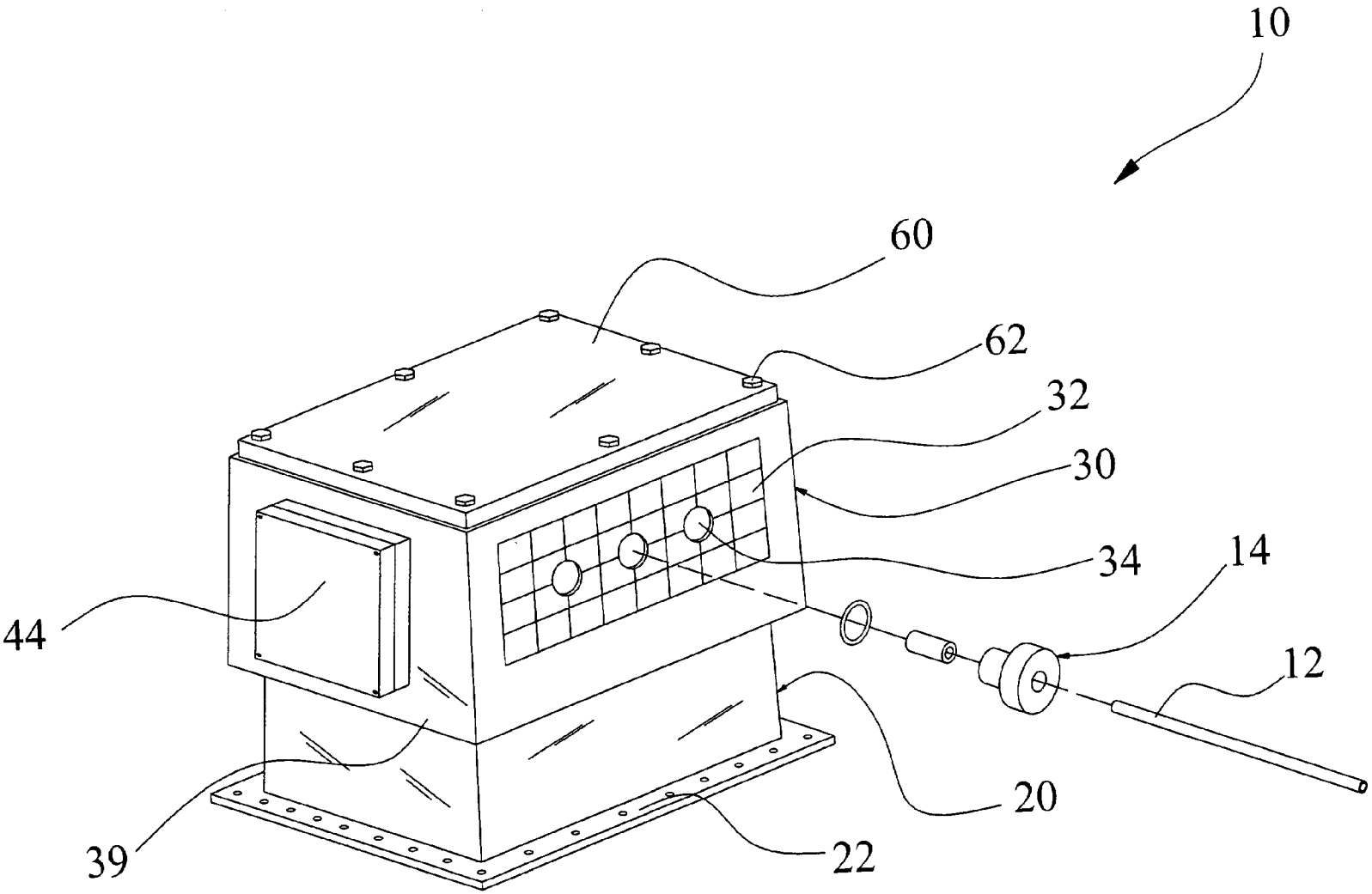
FIG. 1 is an upper perspective view of the present invention.

Turning now descriptively to the drawings, in which similar reference characters denote similar elements throughout the several views, FIGS. 1 through 10 illustrate a roof pipe chase housing system 10, which comprises a roof curb 20, a housing structure 30 attached to the roof curb 20, and a tower structure 70 attached to the housing structure 30. The housing structure 30 has a side panel 32 for allowing one or more access openings 34 to be positioned within that receive a pipe 12 in a sealed manner. The housing structure 30 preferably includes an extended lip 39 that prevents water from entering between the housing structure 30 and the roof curb 20. The tower structure 70 is capable of supporting one or more electrical disconnect switches and other devices.

Figure 2:
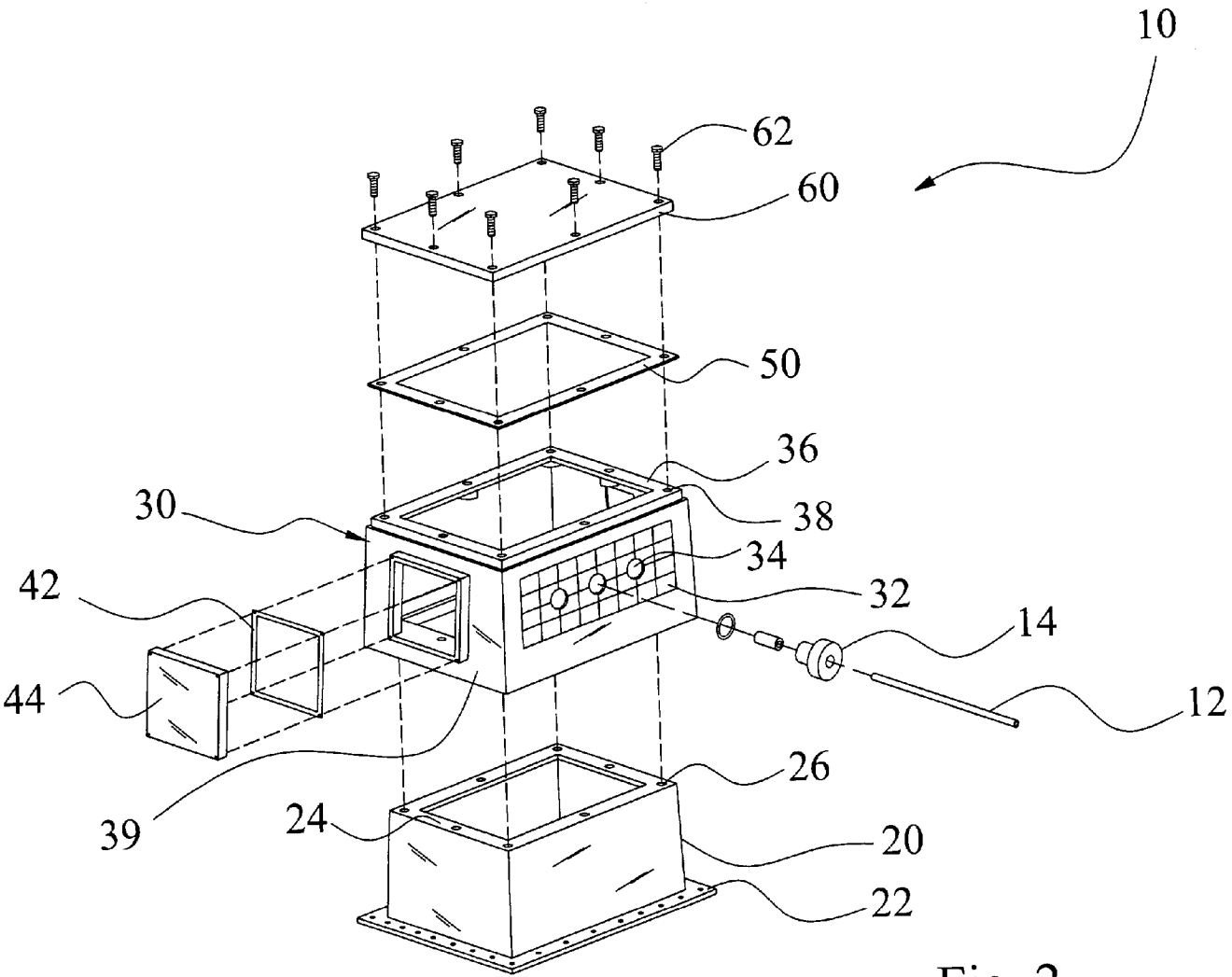
FIG. 2 is an exploded upper perspective view of the present invention.
Figure 3:
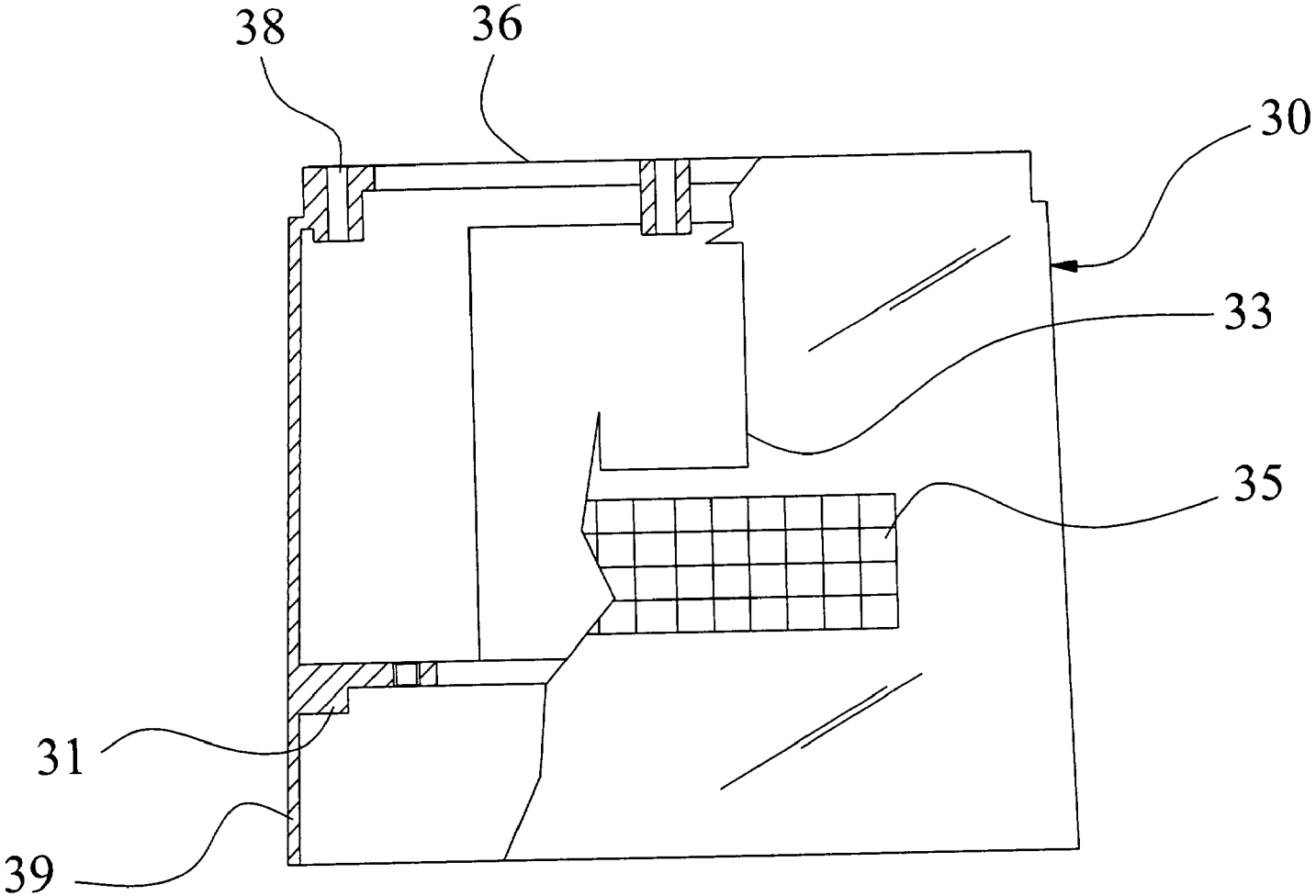
FIG. 3 is an end cutaway view of the present invention.
Figure 4:
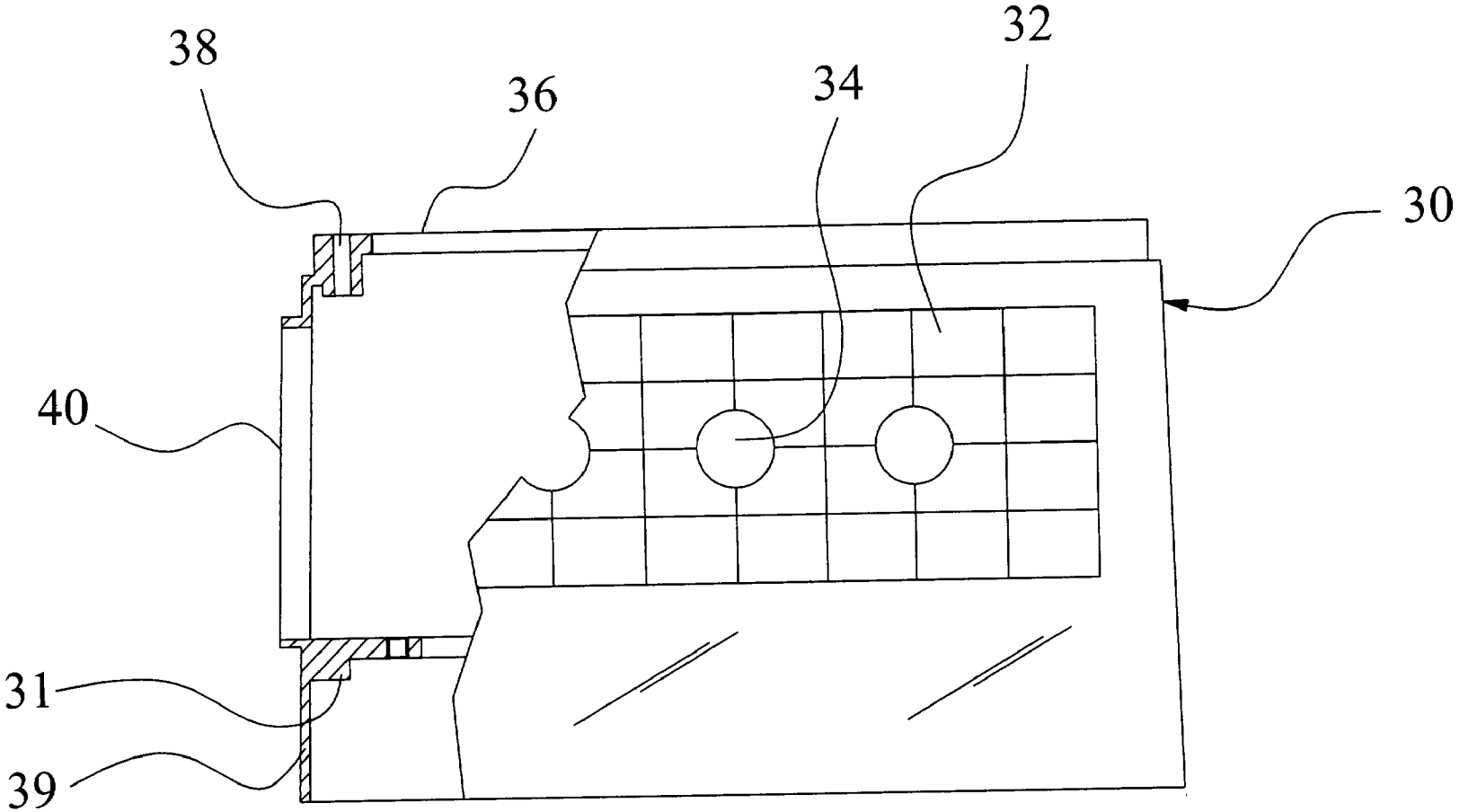
FIG. 4 is a side cutaway view of the present invention.

As shown in FIGS. 1 and 2 of the drawings, the roof curb 20 is comprised of a walled structure having an upper opening formed by an upper curb edge 24. A plurality of upper curb apertures 26 are within the upper curb edge 24 as best shown in FIG. 2 of the drawings. The roof curb 20 preferably has a lower lip 22 for allowing securing to the surface of the roof. A plurality of lower curb apertures may extend into the lower lip 22 as shown in FIGS. 1 and 2 of the drawings. The roof curb 20 may have various shapes other than that illustrated in FIGS. 1 and 2 of the drawings.

The housing structure 30 is designed to fit upon the upper curb edge 24 of the roof curb 20 in a sealed manner. The housing structure 30 has an upper edge 36 having upper apertures 38 that defines an upper opening and a lower edge 31 that defines a lower opening. The lower edge 31 is positioned about the exterior of the roof curb 20 when the housing structure 30 is positioned upon the roof curb 20 to create a seal upon the roof curb 20. An extended lip 39 extends from the lower edge 31 of the housing structure 30 forming a shield from the joint between the housing structure 30 and the roof curb 20 from rain and other debris. Various conventional fastening devices may be utilized to secure the housing structure 30 to the roof curb 20.

Figure 5:
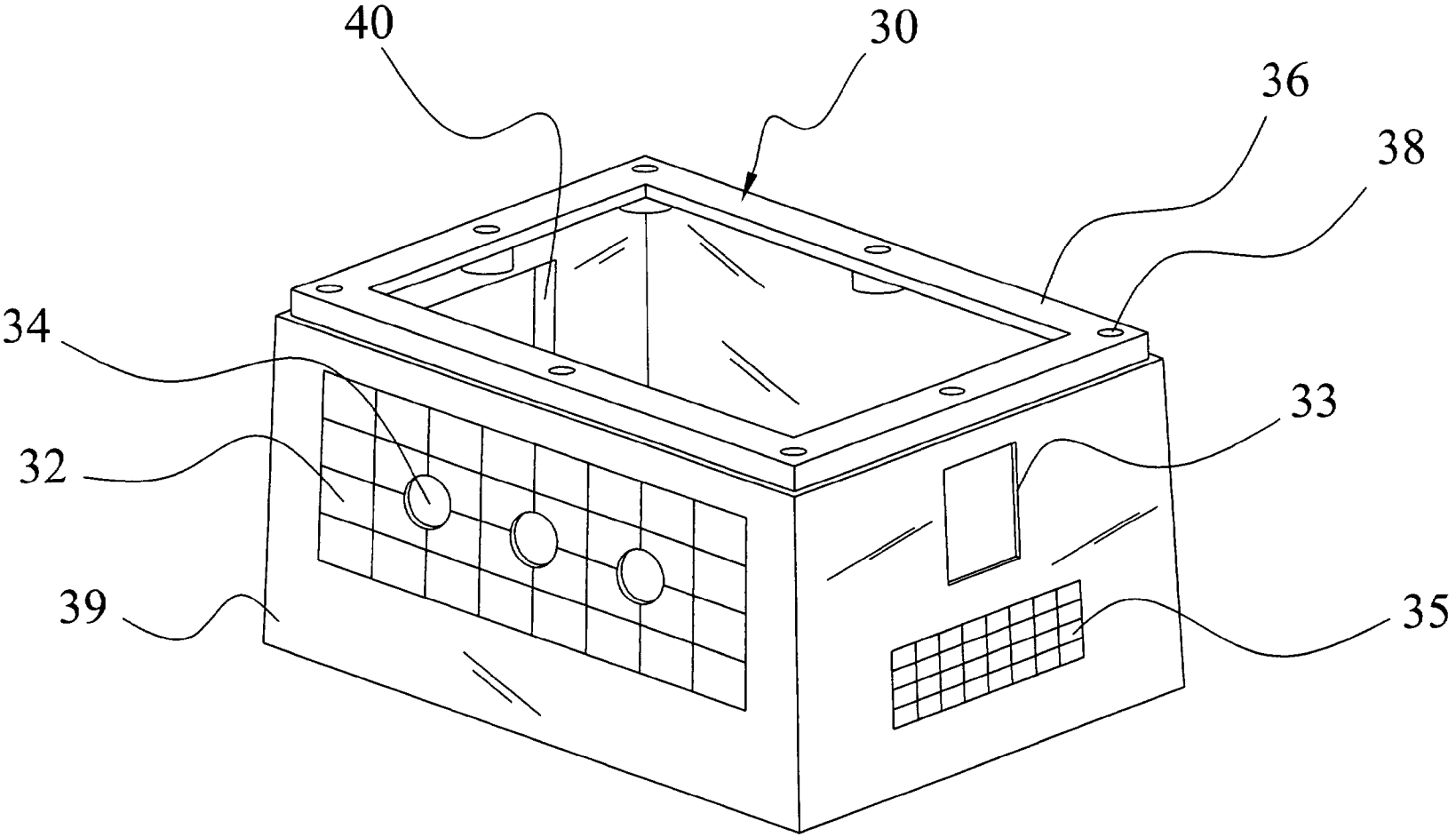
FIG. 5 is an upper perspective view of the housing structure.
Figure 6:
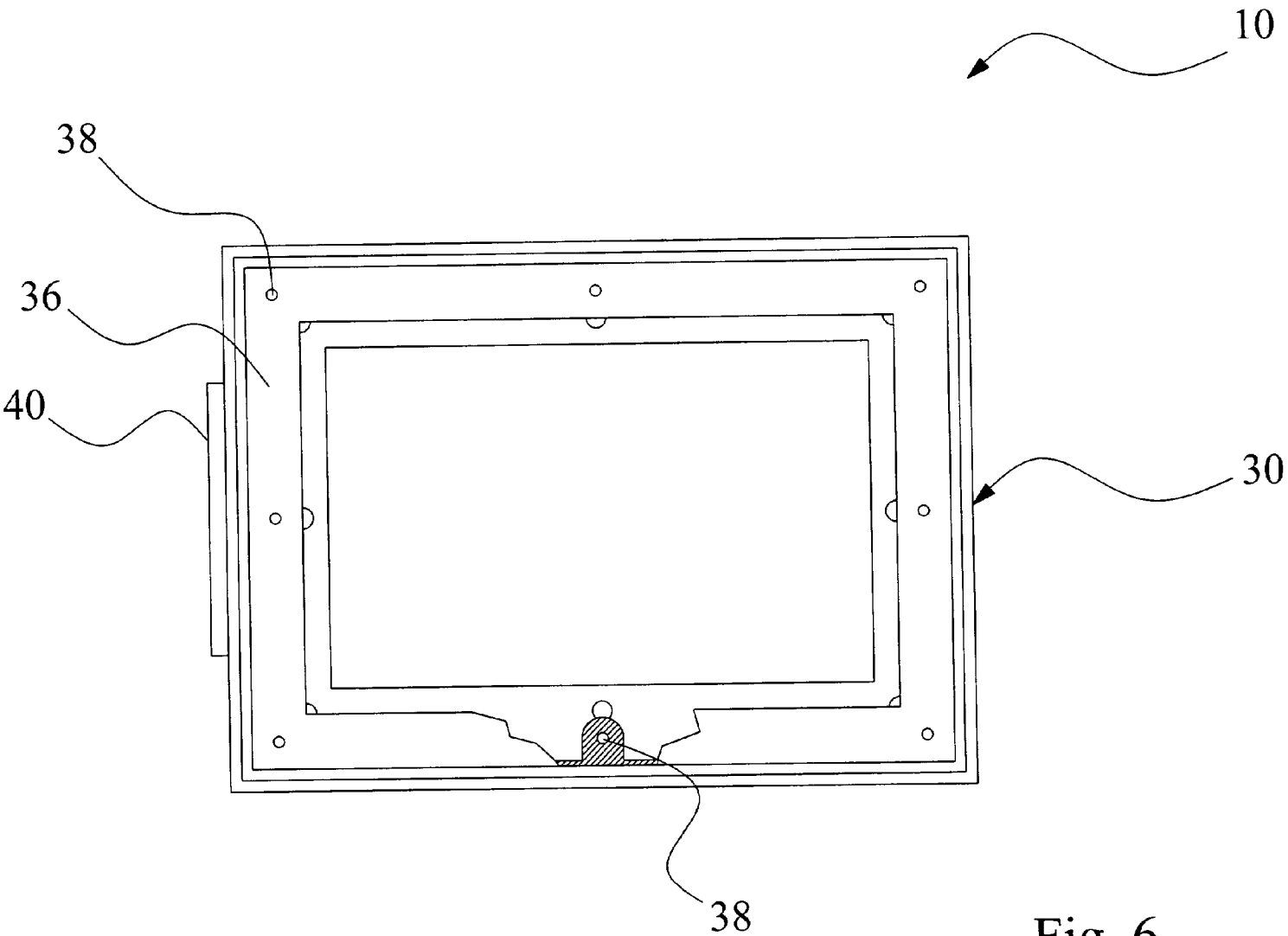
FIG. 6 is a top view of the housing structure.
Figure 7:
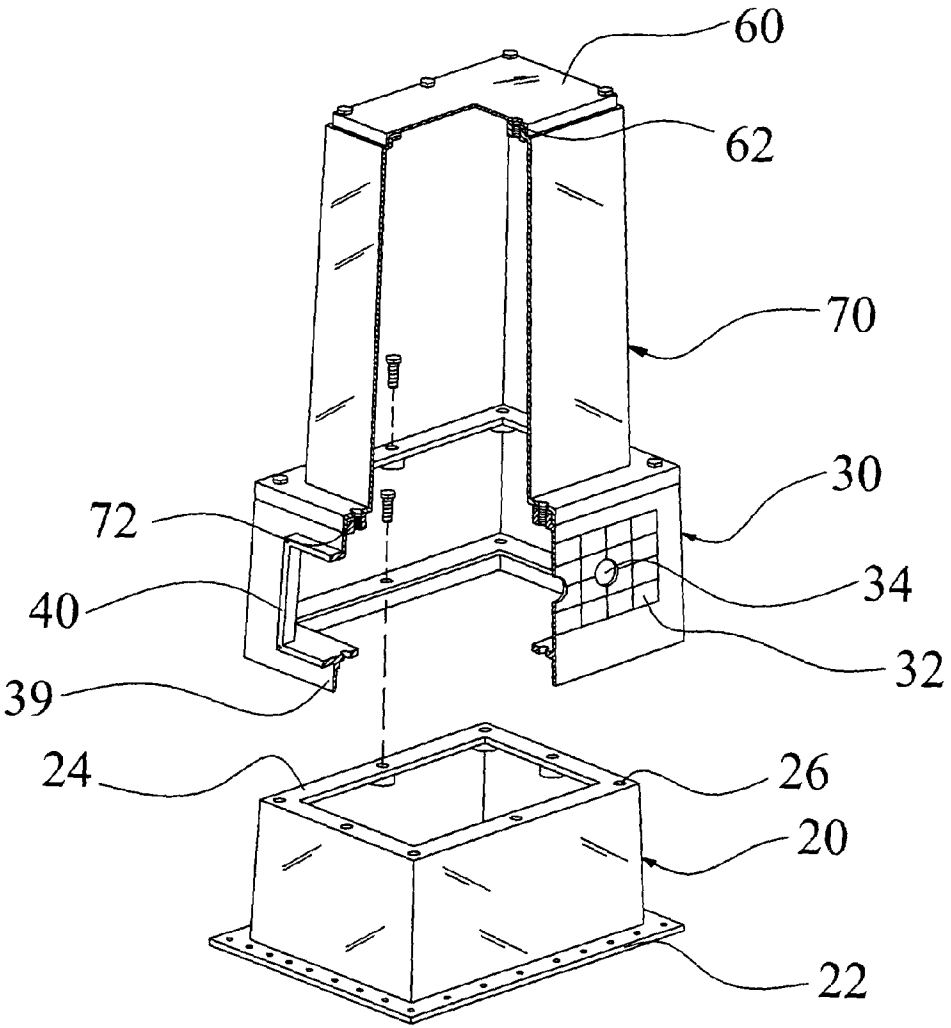
FIG. 7 is a cutaway exploded upper perspective view of the present invention with a tower attached to the housing structure.
Figure 8:
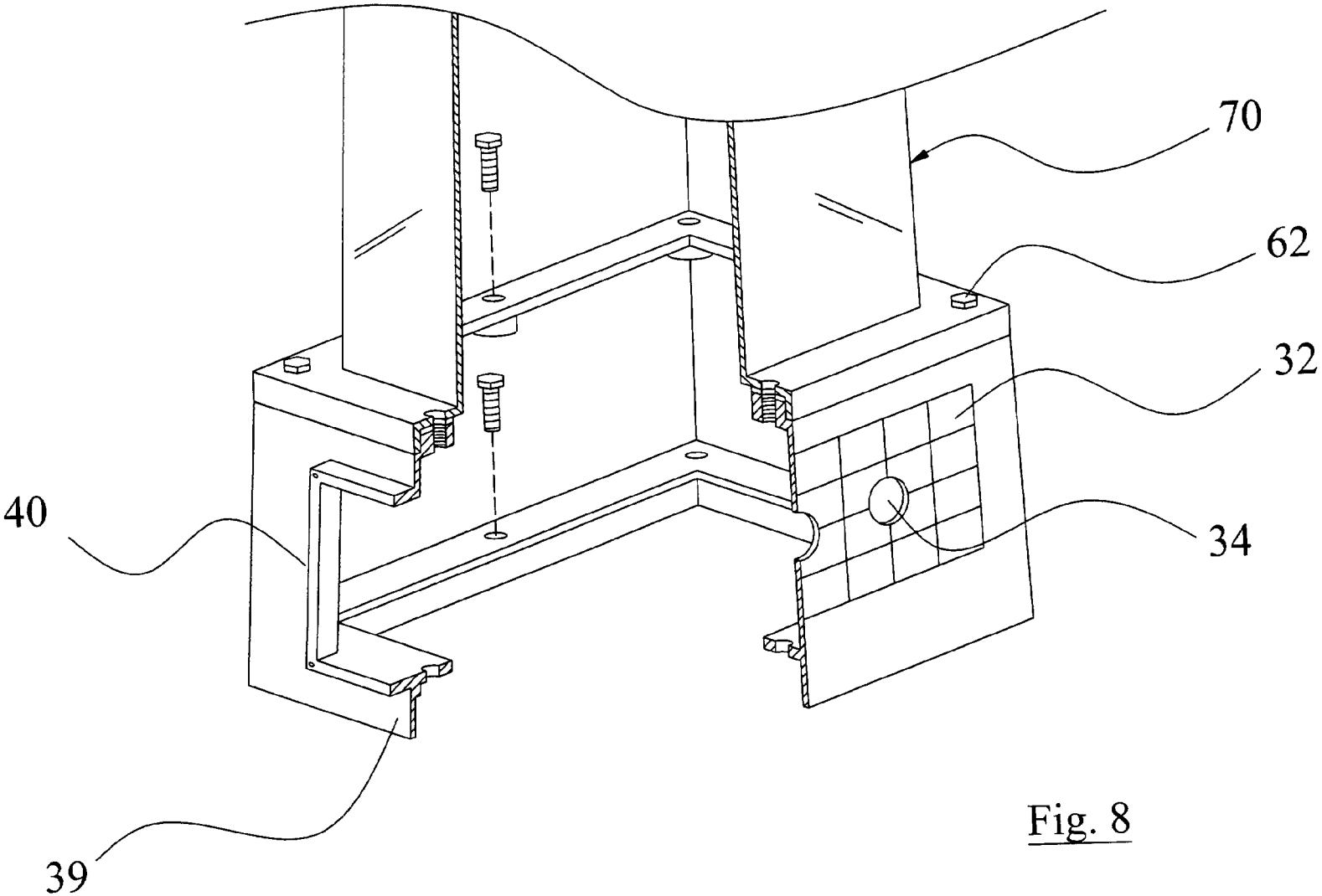
FIG. 8 is a magnified cutaway upper perspective view of the present invention with a tower attached.
Figure 9:
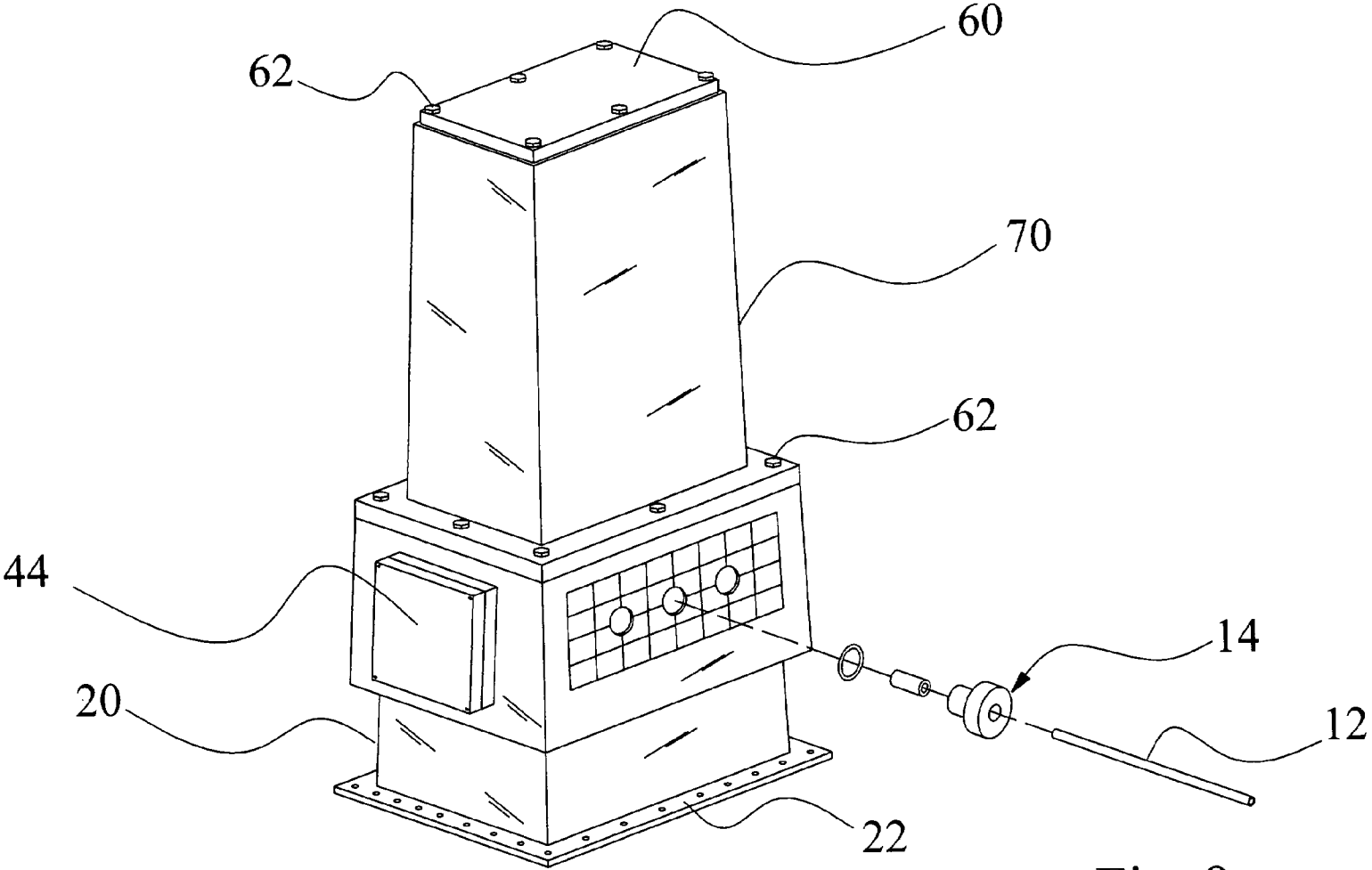
FIG. 9 is an upper perspective view of the present invention with a tower attached.

The housing structure 30 further includes at least one side panel 32 as shown in FIG. 5 of the drawings. The side panel 32 may be comprised of the same material as the housing structure 30 or a different material that is easier to drill access openings 34 within for receiving the pipes 12. At least one end panel 35 is positioned within the housing structure 30 and may also be a different material from the housing structure 30 as the side panel 32. At least one first end opening 33 is positioned within an end of the housing structure 30 for receiving an electrical outlet or other device.

A second end opening 40 is positioned within the housing structure 30 opposite of the first end opening 33. The second end opening 40 may be covered by a side gasket 42 and a side cover 44 as best illustrated in FIG. 2 of the drawings. The second end opening 40 allows for access to the interior of the housing structure 30.

As shown in FIGS. 1 and 2 of the drawings, a first gasket 50 and an upper cover 60 are secured to the upper edge 36 of the housing structure 30 by a plurality of fasteners 62 or other securing device. The upper cover 60 prevents water and debris from entering the housing structure 30 and allows for access within the housing structure 30 for various reasons.

Figure 10:
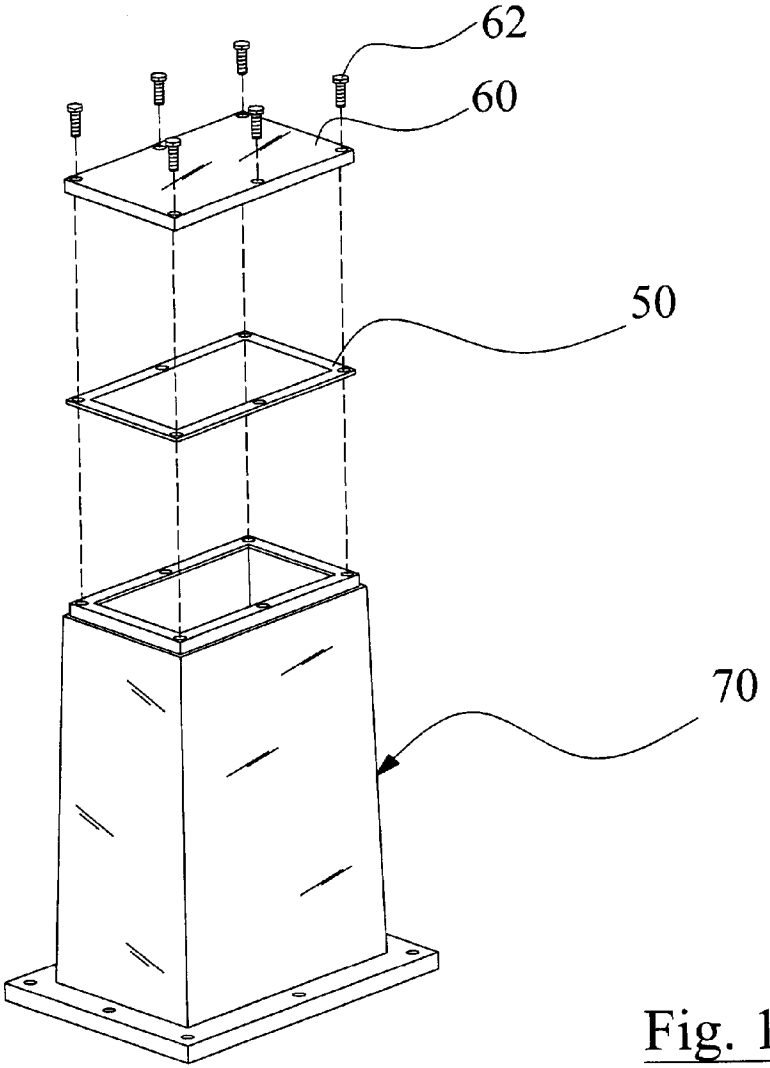
FIG. 10 is an exploded view of the tower.

In an alternative embodiment as shown in FIGS. 7 through 10 of the drawings, a tower structure 70 is provided that may be attached to the upper edge 36 of the housing structure 30 instead of the upper cover 60 using a second gasket 72 in between thereof. The tower structure 70 is a tubular structure having a lower opening and an upper opening as illustrated in FIG. 10 of the drawings. The upper cover 60 and first gasket 50 may be secured to the upper opening of the tower structure 70 by a plurality of fasteners 62 or other fastening devices.

In use, the user secures the roof curb 20 to the roof over an opening within the roof. The roof curb 20 is then sealed upon the roof utilizing conventional roofing materials. The user may then extend the desired pipes 12 through the opening within the roof and secure the desired couplers to the distal ends thereof that will provide an approximately ninety-degree bend within the pipes 12. The user then secures the housing structure 30 to the roof curb 20 and drills the required access openings 34 depending upon the number and location of pipes 12 within the housing structure 30. The user then extends the pipes 12 through the respective access openings 34 within the side panel 32 or end panel 35. A seal assembly 14 or similar seal device may be utilized to seal the pipes 12 within the housing structure 30. The user then may either secure the upper cover 60 to the upper edge 36 of the housing structure 30 or a tower structure 70 depending upon the requirements of the job. In addition, an electrical disconnect switch may be secured to the tower structure 70 and an electrical outdoor outlet may be positioned within the first end opening 33.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A roof pipe chase housing system, comprising:

a roof curb having a first upper opening and a first lower opening;

a housing structure having a second upper opening, a second lower opening, and a lower edge surrounding said second lower opening, wherein said lower edge is secured to said roof curb about said first upper opening;

wherein said roof curb includes a plurality of upper curb apertures that receive fasteners extending through said housing structure;

an upper cover removably secured to said housing structure about said second upper opening;

a panel within said housing structure for receiving an access opening that receives a pipe, wherein said panel is comprised of a material different from said housing structure that is capable of being drilled; and wherein said housing structure includes an end opening, a side gasket and a side cover secured to said end opening.

2. The roof pipe chase housing system of claim 1, wherein said roof curb includes a lower lip.

3. The roof pipe chase housing system of claim 1, wherein said housing structure includes an end panel.

4. The roof pipe chase housing system of claim 1, including a first gasket positioned between said upper cover and said housing structure.

5. The roof pipe chase housing system of claim 1, wherein said housing structure includes an extended lip that extends downwardly from said lower edge.

6. The roof pipe chase housing system of claim 5, wherein said lower edge extends about a side of said roof curb.

7. The roof pipe chase housing system of claim 1, wherein said housing structure includes a second end opening.

8. A roof pipe chase housing system, comprising:

a roof curb having a first upper opening and a first lower opening;

a housing structure having a second upper opening, a second lower opening, and a lower edge surrounding said second lower opening, wherein said lower edge is secured to said roof curb about said first upper opening;

wherein said roof curb includes a plurality of upper curb apertures that receive fasteners extending through said housing structure;

an upper cover removably secured to said housing structure about said second upper opening;

a first gasket positioned between said upper cover and said housing structure;

a panel within said housing structure for receiving an access opening that receives a pipe; and wherein said housing structure includes an end opening, a side gasket and a side cover secured to said end opening.

9. The roof pipe chase housing system of claim 8, wherein said roof curb includes a lower lip.

10. The roof pipe chase housing system of claim 8, wherein said housing structure includes an end panel.

11. The roof pipe chase housing system of claim 8, wherein said panel is comprised of a material different from said housing structure that is capable of being drilled.

12. The roof pipe chase housing system of claim 8, wherein said housing structure includes an extended lip that extends downwardly from said lower edge.

13. The roof pipe chase housing system of claim 12, wherein said lower edge extends about a side of said roof curb.

14. The roof pipe chase housing system of claim 8, wherein said housing structure includes a second end opening.

15. A roof pipe chase housing system, comprising:

a roof curb having a first upper opening and a first lower opening;

a housing structure having a first end opening, a second upper opening, a second lower opening, and a lower edge surrounding said second lower opening, wherein said lower edge is secured to said roof curb about said first upper opening;

wherein said housing structure includes a second end opening, a side gasket and a side cover secured to said second end opening;

an upper cover removably secured to said housing structure about said second upper opening; and a panel within said housing structure for receiving an access opening that receives a pipe.

* * * * *